US005782124A

United States Patent [19]

Lee

[11] Patent Number: 5,782,124

[45] Date of Patent: Jul. 21, 1998

[54] HIGH FORCE REBAR BENDING MACHINE

[76] Inventor: Jimmy D. Lee, 7781 LaMesa, Buena Park, Calif. 90620

[21] Appl. No.: 739,580

[22] Filed: Oct. 30, 1996

[51] Int. Cl.[6] ..... B21D 7/024

[52] U.S. Cl. ..... 72/217; 72/388

[58] Field of Search ..... 72/217, 218, 219, 72/319, 321, 387, 388

[56] References Cited

U.S. PATENT DOCUMENTS

| | | | |
|---|---|---|---|
| 1,462,315 | 7/1923 | Akey et al. | 72/217 |
| 3,531,963 | 10/1970 | Garner et al. | 72/217 |
| 3,713,317 | 1/1973 | Schenck et al. | 72/217 |
| 4,719,783 | 1/1988 | Corry | 72/217 |

FOREIGN PATENT DOCUMENTS

| | | | |
|---|---|---|---|
| 58248 | 1/1912 | Switzerland | 72/218 |
| 2 226 784 | 7/1990 | United Kingdom | 72/217 |

*Primary Examiner*—Lowell A. Larson
*Attorney, Agent, or Firm*—Morland C. Fischer

[57] ABSTRACT

The high force rebar bending machine comprises a frame which carries a bending die. An arm is pivoted to swing around the bending die with a bending roller thereon. Rebar engaged by the bending roller is bent around the die as the arm swings. A fluid cylinder has its piston connected to a cable. The cable is wrapped around a large drive wheel which, in turn, is connected to the arm so that bending force is multiplied. The entire structure is sufficiently compact and light to be portable for use at a job site.

10 Claims, 4 Drawing Sheets

HIGH FORCE REBAR BENDING MACHINE

FIELD OF THE INVENTION

The present invention relates to the field of construction equipment. More specifically, the present invention relates to a hydraulically operated, portable machine for efficient bending of steel reinforcing bar with minimum effort and maximum safety for the user.

BACKGROUND OF THE INVENTION

In construction, reinforcing steel may be supplied in a variety of different forms. Typically, the reinforcing steel is known as rebar and is available in a variety of diameters and textures. The most common texture is that of a double helical raised spiral surface, which forms a pair of opposite spiral patterns as viewed from one end of the rebar to the other. The raised spiral surfaces enable the bar to engage the concrete and is commonly known as deformed bar or rebar.

Rebar is placed into concrete forms to increase the tensile strength of the completed reinforced concrete structure. Often, a rebar structure is prebuilt, sometimes on the job site and sometimes away from the job site. This prebuilt rebar assembly is then placed into the form. In many types of construction, whether using rebar preassemblies or placing rebars into the form on site, is often necessary to leave the rebar ends straight where they extend from the concrete structure. In those cases, the extending ends will need to be left straight until after pouring since the level of the concrete may vary depending on the accuracy of the pour. The shape and amount of the rebar which extends after the concrete is poured is important to the structural integrity of the concrete structure which will be poured later. The placement of rebar bends in the second poured concrete structure is important to strength of the whole structure, and the placement of these bends is related to the finished surface of the first poured concrete structure. Thus, such bends must be made after the first concrete structure is poured.

Further, the structural integrity of the exposed rebar itself is critical to the concrete structure which is poured around the extending rebar. Where the rebar is bent without aid, a sharp bend is made at the surface of the concrete. This is especially harmful and can virtually eliminate the usefulness of the exposed rebar. In the best case, the rebar can simply break off. At least a complete failure will form an overt indication that there is no rebar to use. A complete failure may cause the complete repouring of the structure, but at least it will not lead to reliance on the damaged structure and, therefore, result in a later failure and possible loss of lives.

Other rebar bending methods may involve the manual bending of the rebar around an object placed adjacent the rebar where it extends from the concrete. In some cases, the object will move causing most of the bending to be of small radius at the concrete surface, with only a large radius applied to the remainder of the rebar. In this case, the construction inspector may be misled into believing that the rebar is properly bent when, in fact, the structural damage done is equivalent to that for a sharp angle bend.

Further, the size of the rebar can cause a different result for different objects over which the rebar is bent. The radius of the bend needs to be related to the size of the rebar. A one inch diameter rebar should not be bent about a one-half inch radius and, conversely, a one-quarter inch rebar should not be bent about a 10-inch radius. The bends are sometimes used to terminate the rebar. In such cases, the tensile force parallel to the rebar as it extends from the concrete will not wholly be translated into an axial force with respect to the rebar in the concrete. A sharper bend is associated with the creation of force against the bend, whereas a shallow bend enables the rebar to exert more of an axial pulling force in the concrete into which it is placed.

It is for these reasons that a well-placed bend of proper curvature is so important to enable the resulting structure to maximally take advantage of the full strength available in the rebar, as well as the holding force of the rebar, which extends parallel to and along the surface of the concrete from which it extends. One result of the need for proper placement is the need to have an even radiused bend occur at different selected heights above the surface of the concrete. Where an object is used to assist the bending of the rebar, it will usually not have the stability to enable the bend to occur at different selected heights. Where the person bending the rebar is using force about an object, the object must be of the correct radius and have an adequate height.

Such a bending object would be prohibitive to be placed between extending lengths of rebar, particularly where the spacing is narrow, such as between about six inches and one foot. Further, workers may not be expected to physically transport such a bending object and may require the help of a crane. Even where a structure for rebar bending is employed, the construction worker must still effect the bending. Typically, this is done with mechanical advantage by the use of a pipe placed over the end of the rebar combined with tugging and pulling on the pipe. Even where a properly diameter bending device is present, such haphazard bending is problematic for a number of reasons.

First, the bend may still not be proper. Second, the time for physical manipulation is prohibitive. Third, the bending may "trap" the bending device about which the rebar is bent. The time consumed for a single worker to bend each rebar set, which is prohibitive, will be even worse if manual bending results in a trap of the structure. A trapped structure can cause the worker to have to bend the bar back to free the structure. Bending the rebar both ways significantly weakens the rebar.

What is needed, therefore, in the construction field is a device and method for enabling the quick, safe, easy and sure bending of rebar. The needed device should have a number of characteristics which give it utilitarian advantages on the job. The characteristics should include the inability of the device to become "trapped." The bending should be able to be achieved at varying heights above the level of the concrete surface. The bending should always produce an even radius of curvature. The bending should be automatic to eliminate the energy expenditure by the construction worker. The device used for bending should be portable and as lightweight as possible to facilitate its use between closely set rebar and also at elevations significantly above ground level.

SUMMARY OF THE INVENTION

In order to aid in the understanding of this invention, it can be stated in essentially summary form that it is directed to a high force rebar bending machine which comprises a frame which carries a bending die thereon. An arm is pivoted to swing around the bending die with a bending roller thereon. Rebar engaged by the bending roller is bent around the die as the arm swings. A fluid cylinder has its piston connected to a cable. The cable is wrapped around a large drive wheel which, in turn, is connected to the arm so that bending force is multiplied. The entire structure is sufficiently compact and light to be portable for use at a job site.

It is, thus, a purpose and advantage of this invention to provide a high force rebar bending machine which is sufficiently light that it can be easily moved around a construction site and which is sufficiently strong to be able to bend large rebar.

It is another purpose and advantage of this invention to provide a high force rebar bending machine which is able to be placed into confined locations and bend large rebar in situ so as to overcome the necessity for making all large rebar bends in the shop.

It is a further purpose and advantage of this invention to provide a high force rebar bending machine which is fluid-powered so as to minimize weight and minimize size to aid in placing the rebar bending machine in the location for the desired bend.

Other purposes and advantages of this invention will become apparent from a study of the following portion of the specification, the claims and the attached drawings.

DESCRIPTION OF THE PREFERRED EMBODIMENT

Figure 1:
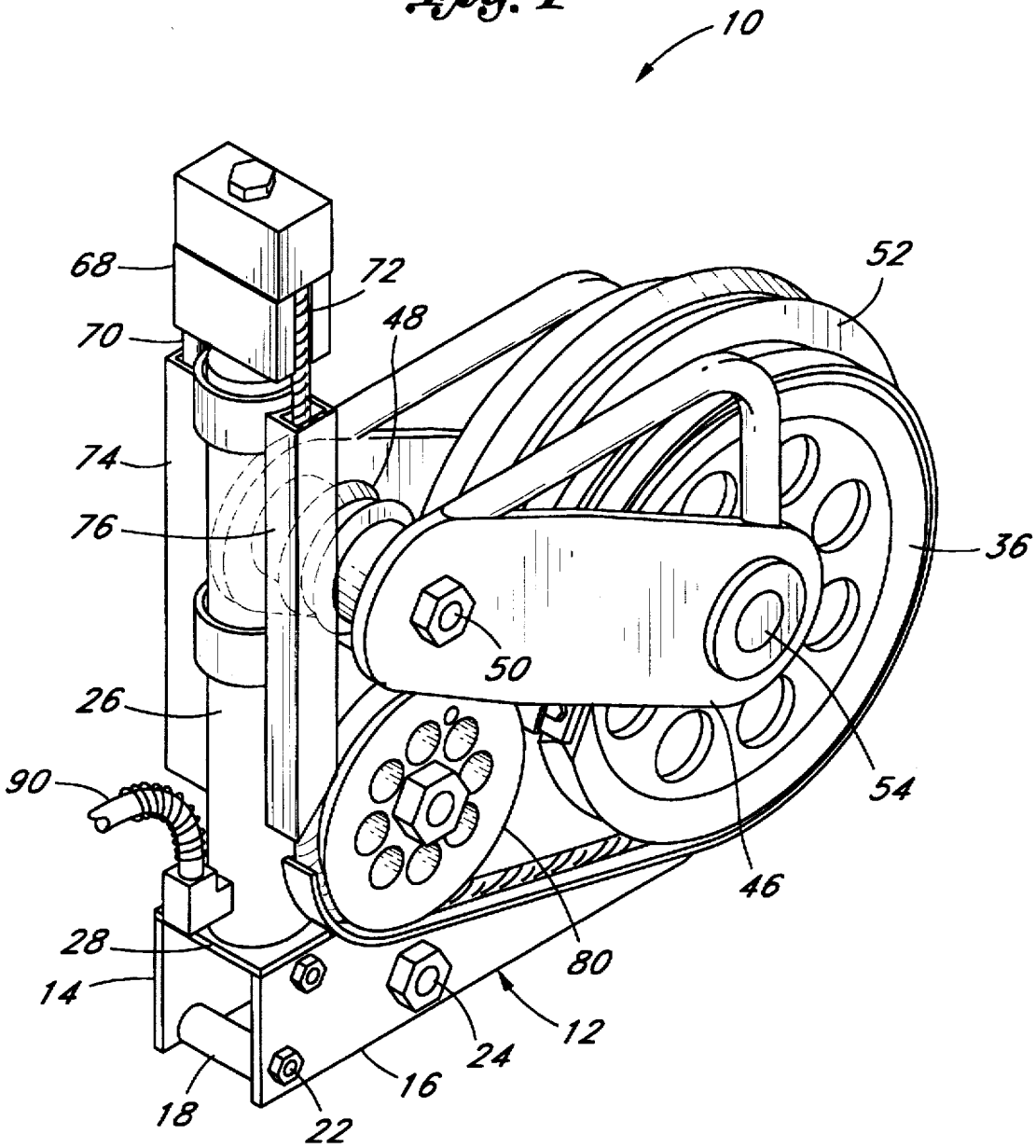
FIG. 1 is an isometric view of the high force rebar bending machine of this invention.
Figure 2:
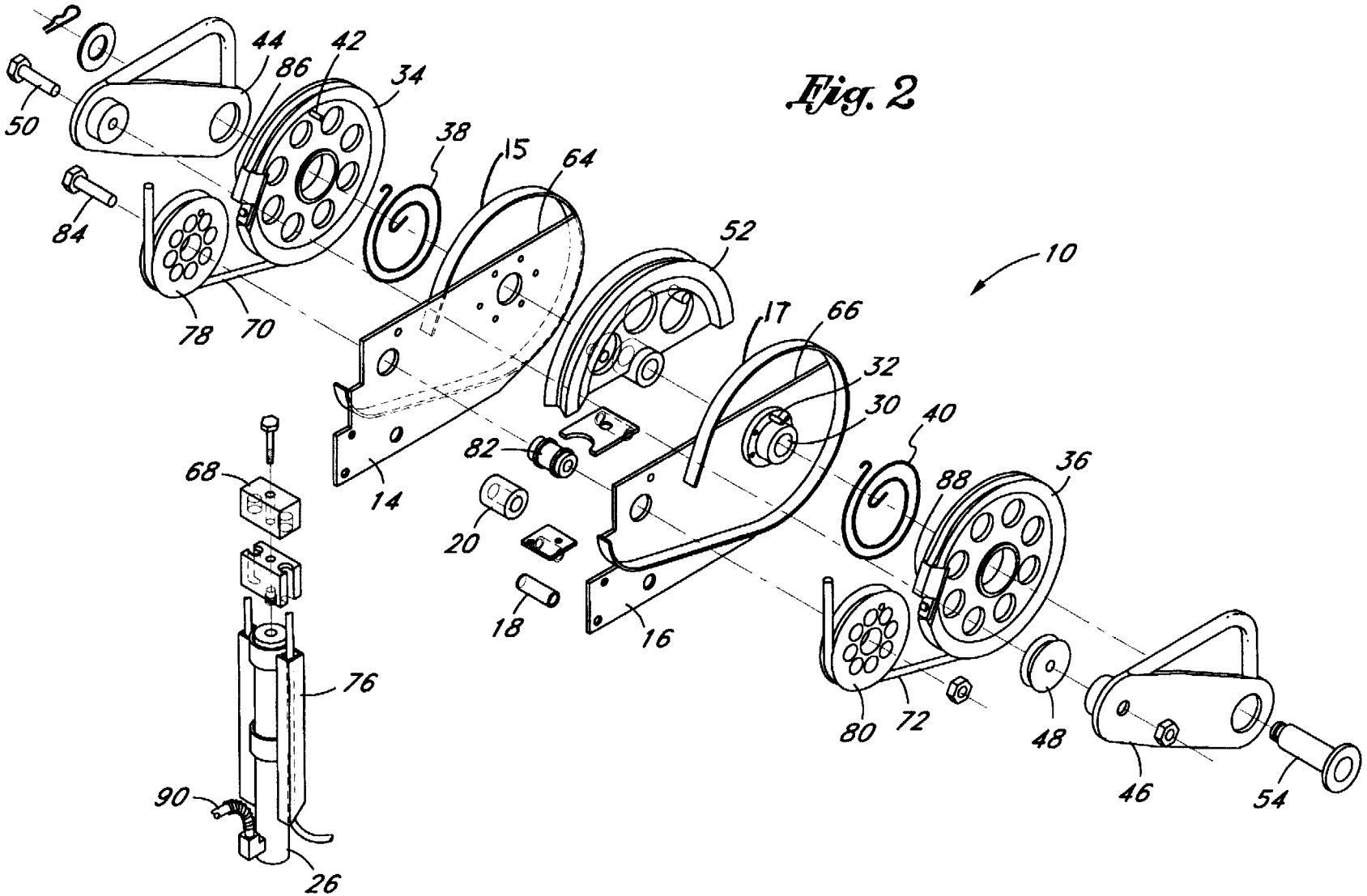
FIG. 2 is a exploded view thereof.

The high force rebar bending machine of this invention is generally indicated at 10 in FIGS. 1, 2, 3, and 4. The machine 10 has a frame 12. The frame 12 is principally formed of left and right side plates 14 and 16. The side plates are secured to each other in spaced position. Spacer 18 therebetween is shown in FIGS. 1 and 2. Spacer 20 is seen in FIG. 2. Bolts 22 and 24, seen in FIG. 1, hold the side plates in that position. The head end of hydraulic cylinder 26 is mounted on plate 28, which serves as a cylinder mounting plate and a side plate spacer.

Figure 4:
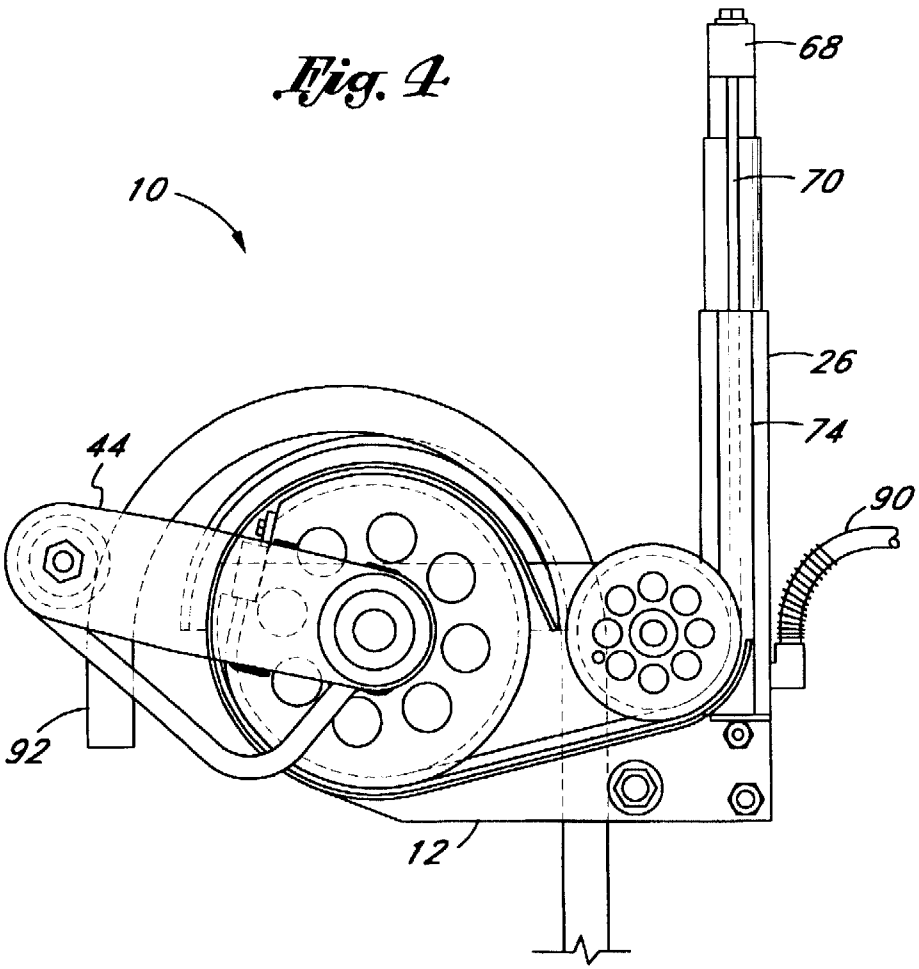
FIG. 4 is a view similar to FIG. 3, shown after a 180 degree bend.
Figure 3:
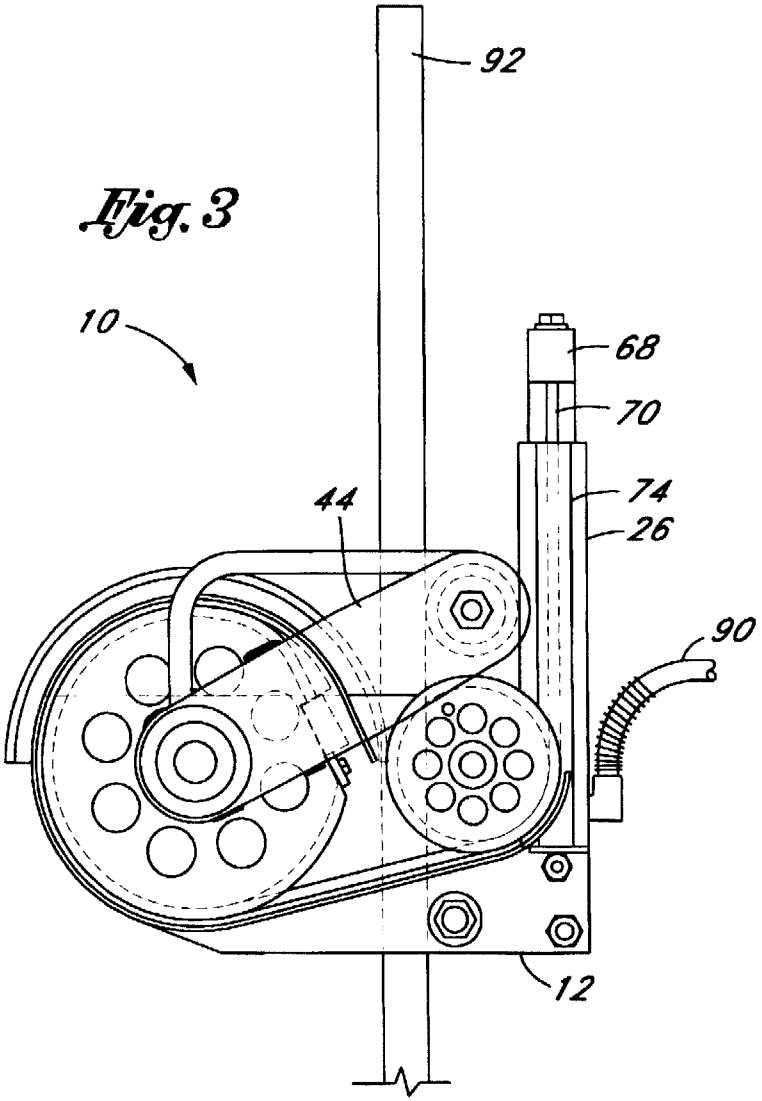
FIG. 3 is a side-elevational view thereof, positioned as it is placed on a rebar prior to bending.

A bushing is mounted on the outside of each side plate. Bushing 30 is shown in FIG. 2. There is another bushing on the far side of side plate 14. The bushings have flanges which permit them to be bolted down. One of the bolts is extended bolt 32. Drive wheels 34 and 36 are respectively rotatably mounted on the bushings extending outward from side plates 14 and 16. Coil springs 38 and 40 are positioned around the bushings and between the side plates and the drive wheels. The springs are flat coils of rectangular spring stock on edge. The springs each have a hook thereon. The inner hook of spring 40 is hooked over the extended bolt 32. The spring 38 is similarly hooked onto a bolt extending from its bushing. The outer end of each spring also has a hook thereon. The outer end of spring 38 is shown as hooked on pin 42 on drive wheel 34. These springs urge the drive wheels to rotate in the counterclockwise direction, opposite to piston force, as seen in FIGS. 1 and 2, and in the clockwise direction, as seen in FIGS. 3 and 4. The cylinder may have a retracting spring, but springs 38 and 40 also keep the cables tight.

Arms 44 and 46 are respectively attached to the outside of the drive wheels 34 and 36, as by welding. Between the outer ends of the arms is positioned bending roller 48. Stub shaft 50 rotatably carries the bending roller 48 between arms 44 and 46. The stub shaft 50 is retained by end nuts and can be removed for removal and replacement of the bending roller. Replacement may be necessary for installing a new bending roller. Removal may be necessary to aid in removing of the bending machine 10 from the bent rebar after the bend is accomplished. Manual handles are provided on the arms 44 and 46 so that the entire machine 10 may be readily moved into place.

Figure 5:
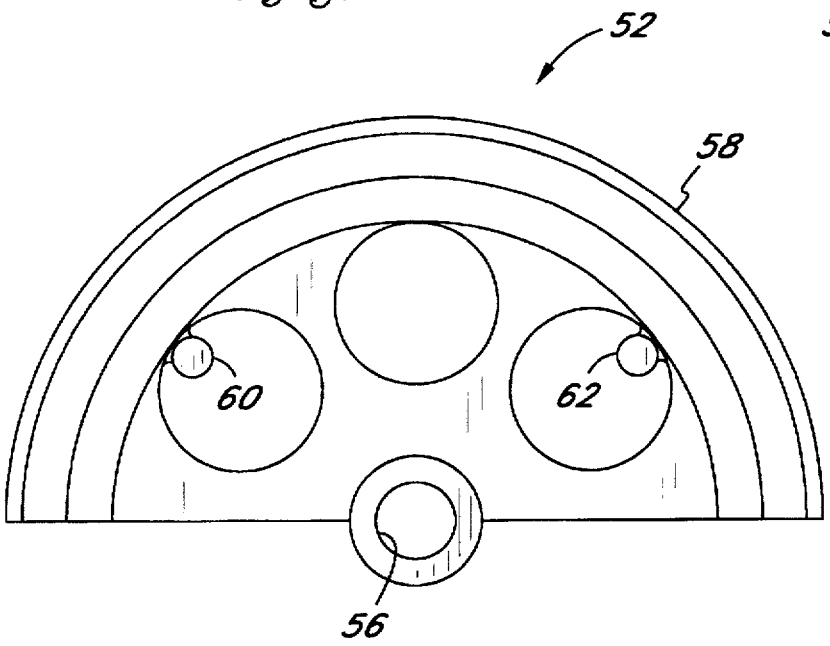
FIG. 5 is an enlarged side-elevational view of the bending die in the rebar bending machine of FIGS. 1 through 4.
Figure 6:
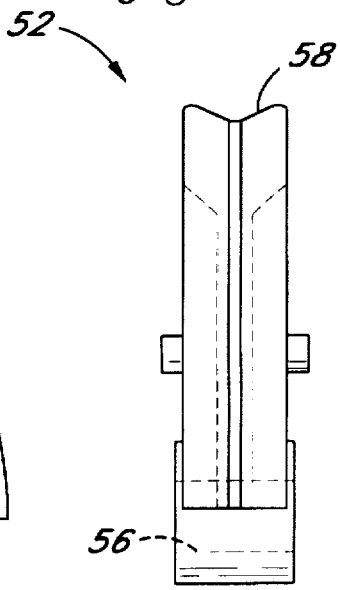
FIG. 6 is an edge view of the die shown in FIG. 5.

Bending die 52 is in the form of a V-grooved half wheel. It is shown in more detail in FIGS. 5 and 6. Pivot pin 54 goes through the bushings upon which the drive wheels are carried and goes through the center hole 56 in the boss in bending die 52. The peripheral surface 58 is V-grooved, as shown in FIG. 6, and is circular around the center hole 56. To prevent bending die 52 from rotating, it has pins 60 and 62, which extend laterally outward and engage over the top edges 64 and 66 of the side plates 14 and 16. Pivot pin 54 is removable and is retained in place by the cotter pin shown in the upper left of FIG. 2. Removal of the cotter pin permits removal of the pivot pin with consequent freedom of the bending die. The bending die can be removed from the center of the machine to aid in removal of the machine from a rebar after bending. The V-shaped peripheral surface 58 permits the bending die to hold the entire rebar bending machine in place during the bending process.

As seen in FIGS. 1, 2, 3 and 4, the rod end of the cylinder 26 is mounted in the upward direction. Cable head 68 is secured to the top of the piston rod extending upward out of cylinder 26. Cables 70 and 72 terminate with button heads which are received by an end cap 69. The cables 70 and 72 then extend downwardly from cap 69 to be secured within vertical slots of a cable anchor 68 and passed through guides 74 and 76 which are attached to the sides of the cylinder 26. The anchor 68 is fixed to the top of the cylinder 26 below end cap 69. The cables are enclosed in metal tubes to avoid abrasion.

Guide wheels 78 and 80 are mounted on the outside of the left and right side plates 14 and 16, respectively. The cables 70 and 72 extend downward and around the guide wheels. From the guide wheels, the cables extend around the drive wheels 34 and 36 and are attached thereto.

Cover 35 is mounted on spacers 37 against side plate 16 to protect the worker against pinching between cable 72 and wheels 36 and 80. A similar cover 39 protects cable 70. The cables are completely enclosed. As seen in FIGS. 1, 2 and 3, when the piston is in the down position, the cable wraps about three-quarters of a turn around the drive wheels 34 and 36. The ends of the cables are clamped to the drive wheels, respectively, with clamps 86 and 88. As is best shown in FIG. 2, arcuate cable guides 15 and 17 extend along the side plates 14 and 16 and then project above and outwardly past the top edges 64 and 66 thereof to advantageously retain cables 70 and 72 within respective grooves of the drive wheels 34 and 36 and the guide wheels 78 and 80 when the bending machine 10 is carried and in the event that one of the cables should snap during use.

Hydraulic hose 90 is connected to the head end of the cylinder to introduce hydraulic fluid under pressure below the piston thereon. The piston is connected to the piston rod upon which the cable head is mounted. Thus, introduction of hydraulic fluid under pressure raises the piston, the piston rod and the cable head 68. The upward movement of the cable head rotates drive wheels 34 and 36 in the clockwise direction, as seen in FIGS. 1 and 2, and in the counterclockwise direction, as seen in FIGS. 3 and 4.

In FIG. 3, the high force rebar bending machine 10 is shown as being mounted on the vertical rebar 92. The rebar is positioned between the left and right side plates 14 and 16 and is positioned between bending roller 48 and bending die 52. Hydraulic fluid under pressure is introduced to the hydraulic hose 90 and to the cylinder. This raises the piston rod, and the cable pulls the drive wheels and arms in the counterclockwise direction from the position in FIG. 3 to the position in FIG. 4. This bends the rebar 92 around the die 52. A 180 degree bend of the rebar 92 is shown in FIG. 4. The bend may stop at any angle by stopping the flow of hydraulic fluid under pressure.

Removal of the pressure from the hydraulic hose and connection of the hose to drain permits the springs 38 and 40 to rotate arms and swing the bending roller back to the initial position shown in FIGS. 1 and 3. If the bending machine cannot be removed easily from the bent rebar, bending die 52 can be readily removed by pulling the pivot pin 54 and removing the rebar bending machine, while leaving the bending die behind. Then, the bending die can be removed from the rebar and reinstalled in the machine.

This invention has been described in its presently preferred best mode, and it is clear that it is susceptible to numerous modifications, modes and embodiments within the ability of those skilled in the art and without the exercise of the inventive faculty. Accordingly, the scope of this invention is defined by the scope of the following claims:

What is claimed is:

1. A high force rebar bending machine, comprising:

a frame and first and second side plates held in spaced alignment with one another by said frame;

a fluid pressure cylinder connected to said frame and having a cable head that moves when fluid is supplied to said fluid pressure cylinder and a fluid pressure is developed therein;

a bending die connected to said frame between the first and second side plates thereof;

at least one drive wheel rotatably connected to said frame adjacent said bending die;

at least one cable connected between the cable head of said fluid pressure cylinder and said drive wheel, said cable extending around at least some of said drive wheel to impart a rotation to said drive wheel;

a rebar engagement means adapted to apply a bending force to a rebar to be bent that is located between said rebar engagement means and said bending die; and at least one bending arm connected at one end thereof to said drive wheel and carrying said rebar engagement means at the opposite end, said cable head moving in response to the fluid pressure developed by said fluid pressure cylinder to apply a pulling force to said cable for causing said drive wheel to rotate relative to said bending die and said bending arm to correspondingly rotate with said drive wheel in a direction towards the rebar to be bent, whereby said rebar engagement means carried by said bending arm engages and bends the rebar to be bent around said bending die.

2. The rebar bending machine recited in claim 1, further comprising at least one cable guide extending along said frame between said fluid pressure cylinder and said at least one drive wheel to surround and hold said cable in alignment with said drive wheel so as to be received therearound.

3. The rebar bending machine recited in claim 1, wherein said rebar engagement means is a roller that rotates with said at least one bending arm and said at least one drive wheel in the direction towards the rebar to be bent to apply a bending force thereto.

4. The rebar bending machine recited in claim 1, wherein said bending die is detachably connected to said frame so as to be removed from between said first and second side plates after the rebar to be bent is bent around said bending die.

5. The rebar bending machine recited in claim 4, further comprising a pin removably connected between the first and second side plates of said frame and extending through said bending die for detachably connecting said bending die between said side plates.

6. The rebar bending machine recited in claim 1, wherein said bending die is fixedly connected between the first and second side plates of said frame so that said at least one drive wheel and said at least one bending arm are rotatable relative to said bending die.

7. The rebar bending machine recited in claim 1, further comprising a handle connected to said frame by which said rebar bending machine is portably transported from place-to-place.

8. The rebar bending machine recited in claim 1, further comprising a spring connected between said frame and said at least one drive wheel to urge said drive wheel and said at least bending arm to rotate in an opposite direction relative to the rebar to be bent when the fluid pressure developed by said fluid pressure cylinder and the corresponding pulling force applied to said at least one cable are removed.

9. The rebar bending machine recited in claim 1, wherein said bending die comprises at least a one half wheel with a V-groove extending around the periphery thereof in which to receive the rebar to be bent.

10. The rebar bending machine recited in claim 1, wherein said at least one bending arm projects radially from said at least one drive wheel so that said rebar engagement means carried by said bending arm is located at a position between said fluid pressure cylinder and said bending die at which position said rebar engagement means engages the rebar to be bent prior to bending the rebar around said bending die.

* * * * *